United States Patent [19]

Panning

[11] Patent Number: 4,739,939

[45] Date of Patent: Apr. 26, 1988

[54] RIPPER TEETH MOUNTING STRUCTURE

[75] Inventor: Martin H. Panning, Thiensville, Wis.

[73] Assignee: Blower Application Company, Germantown, Wis.

[21] Appl. No.: 36,975

[22] Filed: Apr. 10, 1987

[51] Int. Cl.[4] ..... B02C 18/18

[52] U.S. Cl. ..... 241/294

[58] Field of Search ..... 241/293, 294, 295, 242, 241/243, 189 R, 191, 195

[56] References Cited

U.S. PATENT DOCUMENTS

| | | | |
|---|---|---|---|
| 3,797,765 | 3/1974 | Samuels | 241/236 |
| 3,894,697 | 7/1975 | Lawson | 241/159 |
| 4,176,800 | 12/1979 | Brewer | 241/294 X |
| 4,231,530 | 11/1980 | Hatanska | 241/223 |
| 4,330,092 | 5/1982 | Roman | 241/232 |
| 4,360,168 | 11/1982 | Peterson | 241/294 |
| 4,603,816 | 8/1986 | Panning | 241/266 |

*Primary Examiner*—Mark Rosenbaum
*Attorney, Agent, or Firm*—Willis B. Swartwout, III

[57] ABSTRACT

A shredding machine with a cylindrical rotor mounted to rotate with the axle. The exterior surface of the rotor having a plurality of tapped apertures disposed about the surface in arcuately, axially and helically spaced relationship. The rotor has a plurality of circular axially spaced parallel ring sets fixedly mounted thereon. Each set includes a pair of axially spaced parallel rings. The rings of each set have a plurality of arcuately spaced, axially registering notches. Each ring set is positioned to place between the rings a plurality of the apertures which register axially with the notches. A plurality of arcuate spacer segments arcuately positioned between rings of a set and spaced to have arcuate gaps that register with the tapped apertures and ring notches. The head end of each segment adapted to overlay the leading end flange of an arcuate ripper tooth and the trailing end of the tooth and foot end of the segment being spaced from each other arcuately by the diameter of a threaded aperture. A threaded screw and washer to threadably engage the aperture in the cylindrical surface and removably secure the spacer segments and teeth in position.

9 Claims, 4 Drawing Sheets

RIPPER TEETH MOUNTING STRUCTURE

BACKGROUND OF THE INVENTION

The field of the present invention is shredder machinery and specifically improvements related to the ripper teeth for such machinery, the rotor and the mounting of the ripper teeth on the rotor.

While the present invention is most specifically related to shredding machinery for waste products such as waste paper the concept would equally well be used for shredding old or wrecked automobiles or other heavier waste materials with use of appropriate strength materials.

Previous shredding machinery involved the use of rotors, usually a plurality of them mounted on shafts and journaled in the shredding machine for rotational movement. The rotors which are typically cylindrical, were provided with knives, cutting disks or teeth welded or otherwise fixed on the exterior surface of the cylinder.

Second rotor cylinders were often required with combs to clean between the knives, teeth or cutting disks to dislodge temporarily trapped materials being shredded in the machine to prevent clogging and possible damage.

Another significant problem is that when the teeth, knives or cutting disks became worn badly or broken substantial machine down time was required to remove the rotor shaft and rotor and repair or replace the damaged cutting equipment.

In the past, it has been found advantageous to the performance of the machine to wind the knives or cutting disk in a helical fashion about the cylinder, however, this then required that the comb structure on the cooperating rotating cylinder be similarly helically disposed to keep from causing damage to the cutters, knives or teeth.

The present invention proposes to overcome by using axially spaced, helically spaced individually mounted cutting teeth removably mounted to the rotor cylinder surface for easy replacement.

SUMMARY OF THE INVENTION

The present invention is a rotor for a shredding machine which is generally cylindrical in vertical cross-section and mounted on an elongated shaft to rotate therewith and the shaft in turn is journaled in the machine such that the rotor rotates within the shredding chamber of the machine.

The exterior cylindrical surface of the rotor is provided with a plurality of spaced parallel circular ring sets welded to the exterior surface of the rotor. Each ring set is in itself a pair of spaced parallel circular rings welded to the exterior cylindrical surface in narrowly spaced relationship. Each ring is provided with a plurality of arcuately spaced notches and in sets the notches of two rings are arcuately matched to register with each other and with one of a series of arcuately spaced tapped apertures spaced in a pattern axially and helically about the exterior cylindrical surface of the rotor. By matching successive circular ring sets and the arcuately registering notches to the tapped apertures the notches are oriented in a pattern spaced arcuately, helically and axially about the exterior cylindrical surface of the rotor. A plurality of arcuate spacer ring segments are disposed between each ring of a ring set in a progressive manner with an arcuate space between the head end of one segment and the foot end of the preceding segment as viewed counter-clockwise with the arcuate space thus defined oriented to the arcuately spaced tapped apertures. An arcuate tooth segment is designed to be placed in the arcuate space between segments such that the leading end of the tooth segment and the foot end of the arcuate spacer segment are spaced apart by the diameter of the tapped aperture and the trailing end of the tooth segment fits under a shoulder of the head end of the next spacer segment in a clockwise direction with the cutting margin of the tooth segment facing in a counter-clockwise direction. A threaded cap screw with washer is threaded into the aperture such that a washer on the screw overlaps the leading end of the tooth segment and the foot end of the adjacent spacer segment arcuately in a counter-clockwise direction. When the cap screw is tightened down in place the tooth is securely fastened in place and ready to cut or rip material it engages.

It is an object, therefore, of the present invention to provide structure for the exterior surface of a generally cylindrical shredder rotor for removably securing a plurality of ripper teeth to the exterior surface of the cylindrical rotor in an arcuately, axially and helically spaced pattern.

It is another object of the present invention to estblish in struture of the character described a pattern for ripper tooth location on the cylindrical surface of the rotor by providing a plurality of tapped apertures in the surface spaced in an arcuate, axial and helical pattern over the exterior cylindrical surface.

It is a further object of the present invention to provide in structure of the character described a plurality of circular axially spaced and parallel ring sets to be secured to the exterior surface of the cylinder, each set consisting of a pair of axially spaced parallel rings positioned and fixedly secured on the cylindrical rotor surface such that a plurality of arcuately spaced tapped apertures are positioned between each pair of rings of a ring set.

It is still another object of the present invention to provide in structure of the character described notches in the rings of each ring set with a plurality of notches of each set registering with each other axially relative to the rotor cylindrical surface and axially with one of the plurality of arcuately spaced tapped apertures between the rings, the axial registration of the notches and apertures being obtained by securing the rings of each ring set to the cylindrical surface according to the tapped aperture pattern.

It is yet another object of the present invention to provide in structure of the character described a plurality of arcuate spacer segments between the rings of each ring set arcuately spaced about the cylindrical surface of the rotor to define arcuate gaps between the arcuate spacer segments at the locations of the tapped apertures, each arcuate spacer segment being provided with a cut out defining a shoulder adopted to overlay a leading end flange of an arcuate tooth segment slidably positioned between the shoulder of the spacer segment and the cylindrical surface of the rotor, the arcuate tooth segment having a radially projecting ripping surface relative to the cylindrical rotor surface and the trailing end of the tooth segment spaced from the leading end of the next segment arcuately by the diameter of the tapped aperture in the cylindrical rotor surface.

The foregoing and other objects and advantages of the invention will appear from the following description. In the description, reference is made to the accompanying drawings which form a part hereof, and in which there is shown by way of illustration a preferred embodiment of the invention. Such embodiment does not necessarily represent the full scope of the invention, however, and reference is made therefore to the claims herein for interpreting the scope of the invention.

DESCRIPTION OF THE PREFERRED EMBODIMENT

Figure 1:
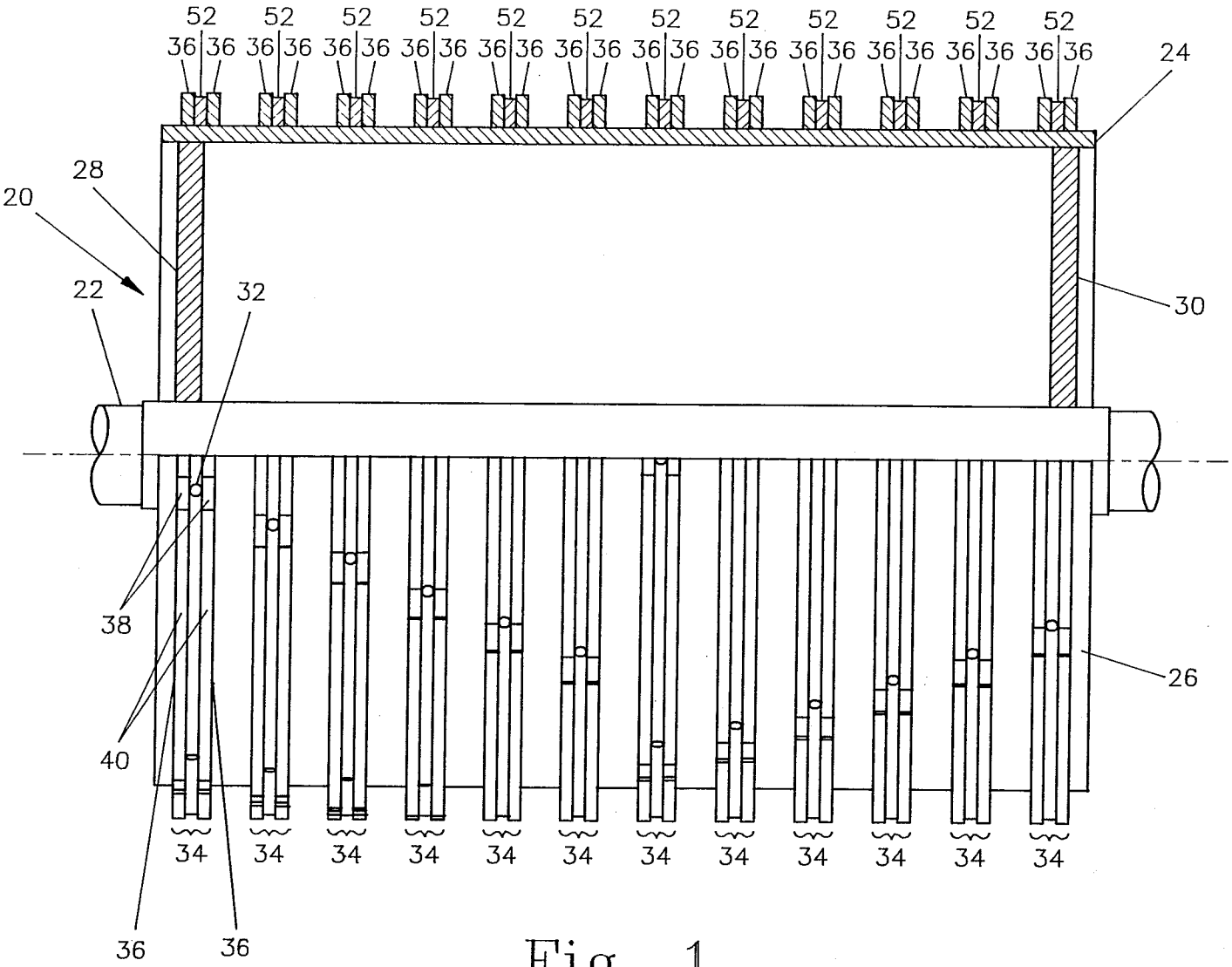
FIG. 1 is a view partly in elevational plan and partly in vertical cross-section of a shredder rotor and axle shaft embodying the present invention.

Referring now to the drawings and more particularly to FIG. 1 thereof, a shredding machine shredder is disclosed and generally identified by the numeral 20.

Shredder 20 is mounted on an elongated axle shaft 22 in a fixed manner to rotate therewith. Shredder 20 is generally like a hollow cylindrical drum having a cylinder 24 including an outer cylindrical surface 26 and end closures 28 and 30.

Figure 2:
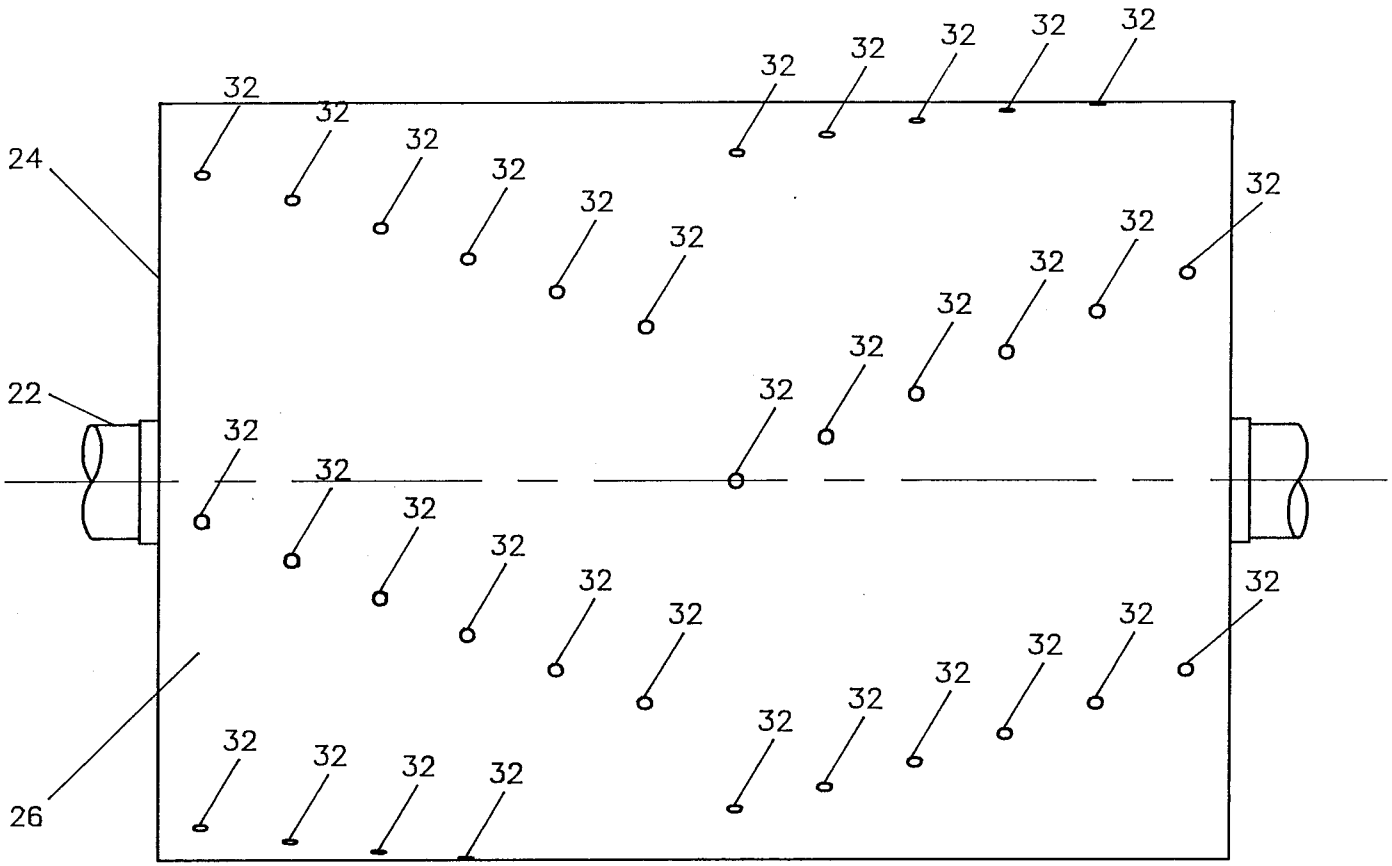
FIG. 2 is an elevational view of the rotor surface prepared for structure embodying the present invention.

Referring particularly to FIG. 2 of the drawings, it will be seen that the exterior or outwardly facing cylindrical surface 26 of cylinder 24 is provided with a plurality of apertures 28. Each aperture 28 is tapped or threaded. Note that these apertures 28 are not random but positioned according to a plan, the apertures are axially spaced relative to cylinder 24 and axle shaft 22. At the same time, a vertical cross-sectional slice through the cylinder 24 would show that the plurality of apertures in any vertical cross-sectional plane through cylinder 24 are arcuately spaced. The foregoing description would not fully carry out the ultimate goal so each arcuately spaced group of apertures in the same vertical plane is arcuately offset relative to the next arcuately spaced group thus creating a helical spacing which could be carried out throughout the entire length of cylinder 24 or as shown in FIG. 2 of the drawings it may move from each end of the cylinder toward the longitudinal midline thereby establishing helical spacing.

Figure 3:
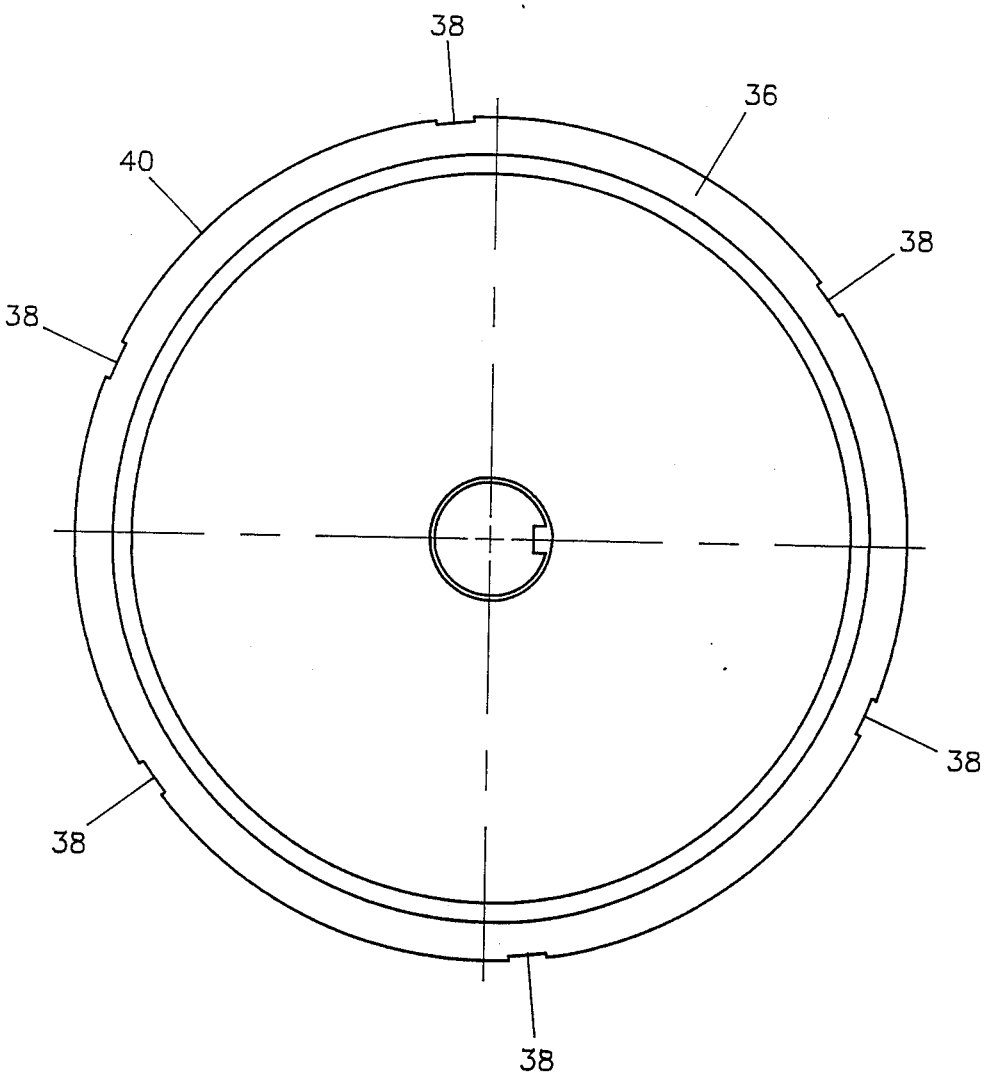
FIG. 3 is an end elevational view of structure embodying the present invention.
Figure 4:
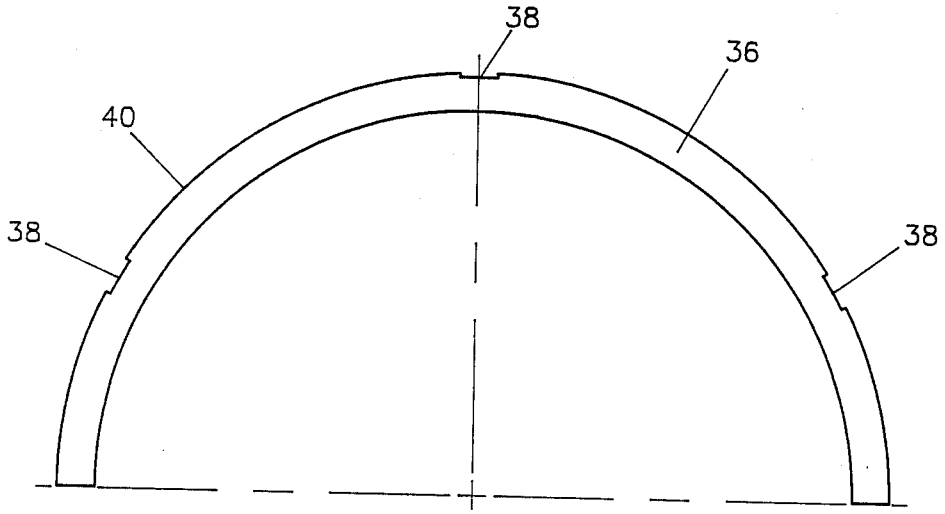
FIG. 4 is a fragmented end elevational view similar to FIG. 3.

Now referring to FIGS. 1, 3 and 4 of the drawings a plurality of ring sets 34 are disclosed affixed to outwardly facing cylindrical surface 26 of cylinder 24 in axially equally spaced parallel relationship.

Each ring set 34 comprises a pair of axially spaced and parallel rings 36. Each ring 36 is provided with a plurality of arcuate notches 38 in its radially outermost surface 40. The relationship of notches 38 to apertures 32 is that the ring 36 will have as many notches 38 as there are apertures 32 in any one vertical plane through cylinder 24. When two rings 36 are a part of the same set 34, the notches 38 of the two rings 36 in the same set 34 register with each other and the set 34 will be affixed to cylinder 24 so as to further place registering notches 38 in axially registering relationship with apertures 32 positioned between the rings 36 of a set 34. This is done for reasons which will hereinafter become apparent. Note, however, at this time that the ring 36 of FIG. 3 of the drawings and the ring 36 of FIG. 4 of the drawings are arcuately offset from each other as can be told from the relative positions of the notches 38 of each ring 36 to the vertical and horizontal centerlines shown in those views. Thus, the ring 36 of FIG. 4 is from a different set 34 than the ring 36 of FIG. 3. The ring 36 of FIG. 4, would be from the set 34 either next succeeding or preceding in axial spacing the ring 36 of FIG. 3.

Figure 5:
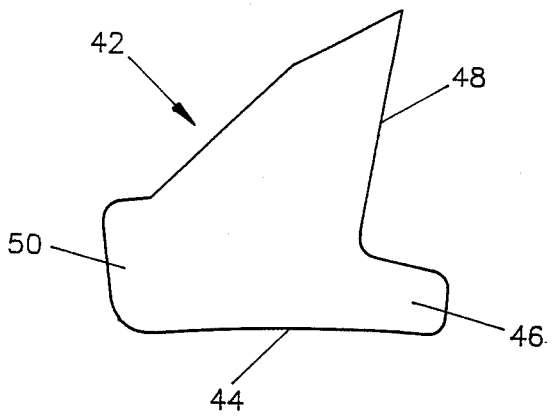
FIG. 5 is a side elevational view of a ripper tooth according to the present invention.

Referring now to FIG. 5 of the drawings, a ripper tooth is shown and generally identified by the numeral 42. Tooth 42 has an arcuate lower surface 44, a leading edge flange 46, a radially projecting ripper or cutter 48 and a trailing edge abutment 50.

Figure 6:
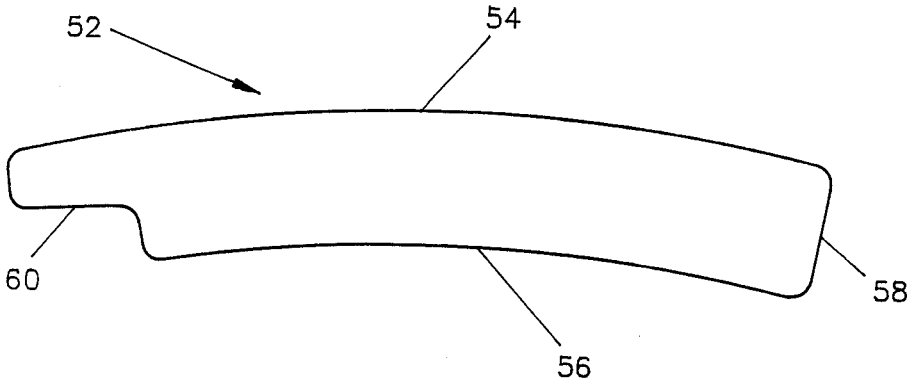
FIG. 6 is a side elevational view of an arcuate spacer segment according to the present invention.

Referring now to FIG. 6 of the drawings, an arcuate spacer segment 52 is disclosed having arcuate upper and lower surfaces 54 and 56 respectively. Also, segment 52 has a head end abutment surface 58 and a foot end shoulder cut out surface 60.

Figure 7:
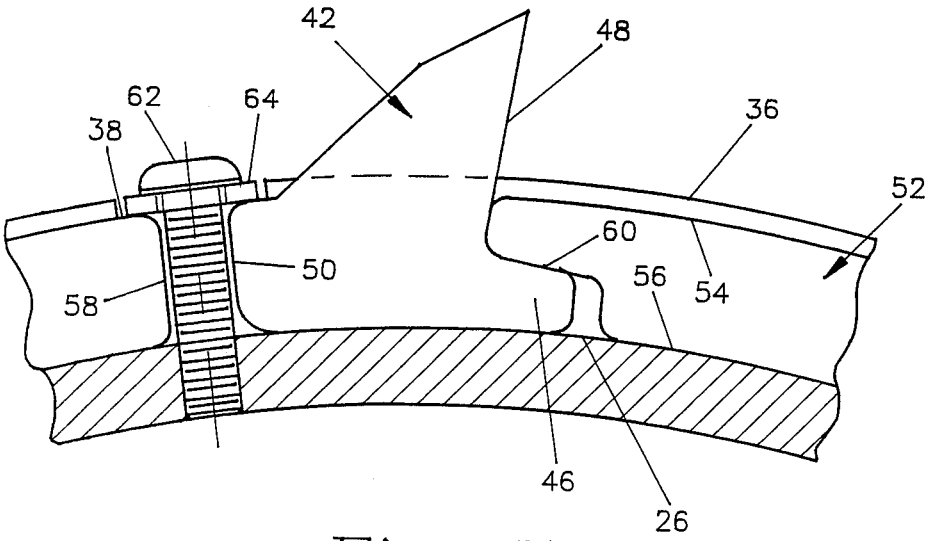
FIG. 7 is a fragmented view partially in side plan and partially in vertical cross-section showing details of the assembly of the present invention.

Referring now in particular to FIGS. 1 and 7 of the drawings, it may easily be seen that spacer segments 52 are placed between rings 36 of a set 34 in arcuately spaced relationship intermediate arcuately spaced apertures 32. Having two spacer 52 segments in place, a tooth 42 is then inserted in the arcuate space between two spacer segments 52 such that flange 46 of tooth 42 slides under shoulder out surface 60 and an arcuate space is created between trailing edge abutment 50 and head end abutment 58 just large enough for a cap screw fastener 62 with a washer 64 under the screw head to be fed down into the arcuate space between abutments 50 and 58, threadably engaged with tapped aperture 32. As the cap screw 62 is tightened into place, washer 64 fits snugly into a position overlying the top surfaces of abutments 50 and 58 and the arcuate surface of notch 38 of each ring 36 of a set 34.

Thus, it can be seen that all the placement features of the invention desired having been obtained and also that any one tooth 42 may be easily removed and replaced in the event it becomes dull or worn or is broken without any lengthy shut down time. Even an entire set of teeth 42 may be easily and quickly removed and replaced and the axle shaft and cylinder rotor of shredder 20 never removed from their journaled position in the shredding unit.

I claim:

1. Improved shredder rotor structure for a shredding machine comprising:

(a) an elongated axle shaft;

(b) a generally cylindrical rotor fixedly mounted to said shaft, the exterior surface of said rotor being provided with a plurality of tapped apertures disposed about the cylindrical rotor surface in arcuate, axial and helical spaced relationship to each other; and (c) means for positioning and removably securing a plurality of ripper teeth on said cylindrical rotor surface according to the relationship of the arcuately, axially and helically spaced relationship of the apertures including a plurality of axially spaced and parallel ring sets secured on the cylindrical rotor surface in a spaced relationship that assures that all of the tapped aperture in the surface of the cylindrical rotor that fall in the same vertical plane through said cylindrical rotor are located within the same ring set.

2. The structure as set forth in claim 1, wherein each ring set consists of a pair of axially spaced and parallel rings said spacing of said rings in an axial direction being sufficient to slightly exceed the diameter of said tapped apertures there between.

3. The structure as set forth in claim 2, wherein each ring of each ring set is provided with a plurality of arcuate notches in its radially outward surface and the number of said notches in any ring is the number of apertures that fall in a vertical plane taken through said cylindrical rotor at any tapped aperture location.

4. The structure as set forth in claim 3, wherein the rings of any ring set are fixed to the cylindrical drum such that the notches in the rings of both rings in the set axially register with each other and with the tapped apertures in the vertical plane through the rotor cylinder at the location of any tapped aperture.

5. The structure as set forth in claim 4, wherein an arcuate spacer member is inserted between the rings of a ring set and arcuately disposed to cover the arcuate space between any two tapped apertures within the vertical plane through the cylindrical rotor at the location of any tapped aperture, the arcuate spacing member having a head end at one arcuate extremity and a foot end at the other arcuate extremity, the number of arcuate spacers placed between any one set of rings in a ring set being determined by the number of arcuate spaces between tapped apertures in the vertical plane through the cylindrical rotor at the location of any aperture.

6. The structure as set forth in claim 5, wherein all of the arcuate spacing members are aligned to have their head end and foot end facing in the same arcuate direction and where the head and foot ends of successive spacing members are spaced apart a short arcuate distance at the location of the tapped apertures.

7. The structure as set forth in claim 6, wherein the head end of each arcuate spacer segment is an abutment end and the foot end is cut out to form a retaining shoulder, the arcuate dispersal of succeeding segments being such that a head abutment end of one segment is slightly spaced from but adjacent to the foot end of the next succeeding arcuate spacer segment.

8. The structure as set forth in claim 7, wherein said means further includes a plurality of arcuate ripper teeth, each said tooth having a leading edge flange, a trailing edge abutment surface and an upwardly projecting ripper cutting surface which when said teeth are positioned on said cylinder will project radially outwardly therefrom, the leading end flange of said teeth being adapted to fit slidably under the foot retaining shoulder in a spacer segment when the tooth is positioned in the space between arcuately successive spacer segments, leaving an arcuate space between the trailing abutment portion of the tooth and the head abutment end of the next arcuately successive spacer segment approximately the diameter of a tapped aperture in the cylindrical surface.

9. The structure as set forth in claim 8, wherein said means further includes a threaded cap screw and washer which is threadably engaged with a tapped aperture by insertion in the space between a ripper tooth trailing abutment and the head abutment of the adjacent spacer segment, a washer being provided on said cap screw directly beneath the head thereof which seats over the respective head abutment of an arcuate spacer segment and trailing end abutment of a tooth and in the axially registering notches of the rings of a ring set securing the ripper tooth in fixed radially outwardly protruding position relative to the cylindrical rotor surface.

* * * * *